US006836638B2

(12) United States Patent
Muto et al.

(10) Patent No.: US 6,836,638 B2
(45) Date of Patent: Dec. 28, 2004

(54) CLEANING DEVICE AND IMAGE FORMING APPARATUS PROVIDED WITH SAME

(75) Inventors: Kazuhumi Muto, Toride (JP); Jun Asai, Nagareyama (JP); Koki Watanabe, Moriya (JP); Keizo Ogara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/724,090

(22) Filed: Dec. 1, 2003

(65) Prior Publication Data

US 2004/0109712 A1 Jun. 10, 2004

Related U.S. Application Data

(62) Division of application No. 10/095,014, filed on Mar. 12, 2002, now Pat. No. 6,694,122.

(30) Foreign Application Priority Data

| | | |
|---|---|---|
| Mar. 14, 2001 | (JP) | 2001/072781 |
| Jul. 31, 2001 | (JP) | 2001/232578 |
| Jul. 31, 2001 | (JP) | 2001/232773 |

(51) Int. Cl.[7] ..... G03G 21/00

(52) U.S. Cl. ..... 399/350; 399/351

(58) Field of Search ..... 15/1.51, 256.5, 15/256.51; 399/345, 350, 351, 352, 353

(56) References Cited

U.S. PATENT DOCUMENTS

| | | | | |
|---|---|---|---|---|
| 4,984,019 A | | 1/1991 | Folkins | |
| 5,138,394 A | | 8/1992 | Watanabe et al. | |
| 5,396,319 A | * | 3/1995 | Tokuhashi et al. | 399/351 |
| 5,752,151 A | | 5/1998 | Inoue et al. | 399/350 |
| 6,128,461 A | | 10/2000 | Yoshikawa | 399/350 |

FOREIGN PATENT DOCUMENTS

| | | |
|---|---|---|
| JP | 6-4014 | 1/1994 |
| JP | 9-160455 | 6/1997 |
| JP | 11-174922 | 7/1999 |

* cited by examiner

*Primary Examiner*—Hoang Ngo
(74) *Attorney, Agent, or Firm*—Fitzpatrick, Cella, Harper & Scinto

(57) ABSTRACT

A cleaning device includes a cleaning member, which is contactable to a moving image bearing member to clean a surface of the image bearing member; a holder holds the cleaning member; and a vibrator. The holder is movable in a direction substantially perpendicular to a surface of the image bearing member. The vibrating means is supported by the holder.

11 Claims, 7 Drawing Sheets

CLEANING DEVICE AND IMAGE FORMING APPARATUS PROVIDED WITH SAME

CROSS-REFERENCE TO RELATED APPLICATION

This application is a divisional application of application Ser. No. 10/095,014, filed Mar. 12, 2002 now U.S. Pat. No. 6,694,122.

FIELD OF THE INVENTION AND RELATED ART

The present invention relates to a cleaning device cleaning a surface of an image bearing member in an image forming apparatus such as a printer, a copying machine, a facsimile or the like and an image forming apparatus provided with the same.

A cleaning blade is known as a cleaning member for cleaning an image bearing member in an image forming apparatus such as a printer, a copying machine, a facsimile or the like.

For example, in an image forming apparatus of an electrophotographic type, a toner image is formed on a photosensitive drum (image bearing member) through image forming processes including a charging process, an exposure process and a developing process, and the toner image is transferred onto a recording material (paper, for example) from a photosensitive drum by a transfer process. In the transfer process, the toner constituting the toner image on the photosensitive drum is not entirely transferred onto the recording material, but a small amount of the toner remains on the surface of the photosensitive drum. The toner remaining on the surface of photosensitive drum (residual toner) is removed from the surface of photosensitive drum by the cleaning blade.

As shown in FIG. 6, an edge 61*a* of a cleaning blade 61 is contacted to the surface of the photosensitive drum 11, by which the residual toner deposited on the surface of the photosensitive drum 11 is scraped off the drum surface.

However, the conventional example involves the following problems.

As shown in FIG. 6, in the neighborhood of the edge 61*a* of the cleaning blade 61 contacted to the photosensitive drum 11, the residual toner scraped off the surface of the photosensitive drum 11 is accumulated. Normally, the accumulated residual toner falls into a cleaner container (unshown) of the cleaning device when the residual toner becomes large to a certain extent.

However, since the recent demand for the high-speed operation of the image forming apparatus results in an increased peripheral speed (process speed) of the photosensitive drum 11, the amount of residual toner does not decrease but increases, depending on the ambient conditions, and the residual toner may pass through the nip N formed between the edge 61*a* of the cleaning blade 61 and a surface of the photosensitive drum 11. The problem with this is that residual toner having passed through the nip is transferred onto the recording material (sheet material) in the next image forming process with result of stripes being produced on the resultant image.

As for a means for improving the cleaning property of the cleaning blade, Japanese Laid-open Patent Application Hei 6-4014 and Japanese Laid-open Patent Application Hei. 11-174922 propose imparting vibration to the cleaning blade using a piezoelectric element. The piezoelectric element is mounted on the cleaning blade. The cleaning blade deteriorates with use, and therefore, the piezoelectric element is replaced when the cleaning blade is replaced. This increases the cost. Additionally, it is difficult to impart such a vibration as is sufficient to remove the residual toner. A method as proposed in Japanese Laid-Open Patent Application Hei. 9-160455 in which the cleaning blade is imparted with collision vibration, may create such a vibration as is enough to remove the coagulated and grown toner. However, depending on the behavior of the cleaning blade when the collision vibration is imparted, the residual toner may pass through the nip.

SUMMARY OF THE INVENTION

Accordingly, it is a principal object of the present invention to provide a cleaning device and an image forming apparatus in which coagulation of the toner is effectively prevented in the neighborhood of the cleaning member, thus properly removing the toner image from the image bearing member.

According to an aspect of the present invention, there is provided a cleaning device comprising a cleaning member, which is contactable to a moving image bearing member, to clean a surface of the image bearing member; holding means for holding said cleaning member; and vibrating means, which is vibratable, wherein said holding means is movable in a direction substantially perpendicular to a surface of the image bearing member, and wherein said vibrating means is supported by said holding means.

According to another aspect of the present invention, there is provided an image forming apparatus comprising a movable image bearing member; image forming means for forming an image on said image bearing member; a cleaning member contacted to said image bearing member to clean a surface of said image bearing member; holding means for holding said cleaning member; and vibrating means, which is vibratable, wherein said holding means is movable in a direction substantially perpendicular to a surface of the image bearing member, and wherein said vibrating means is supported on said holding means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
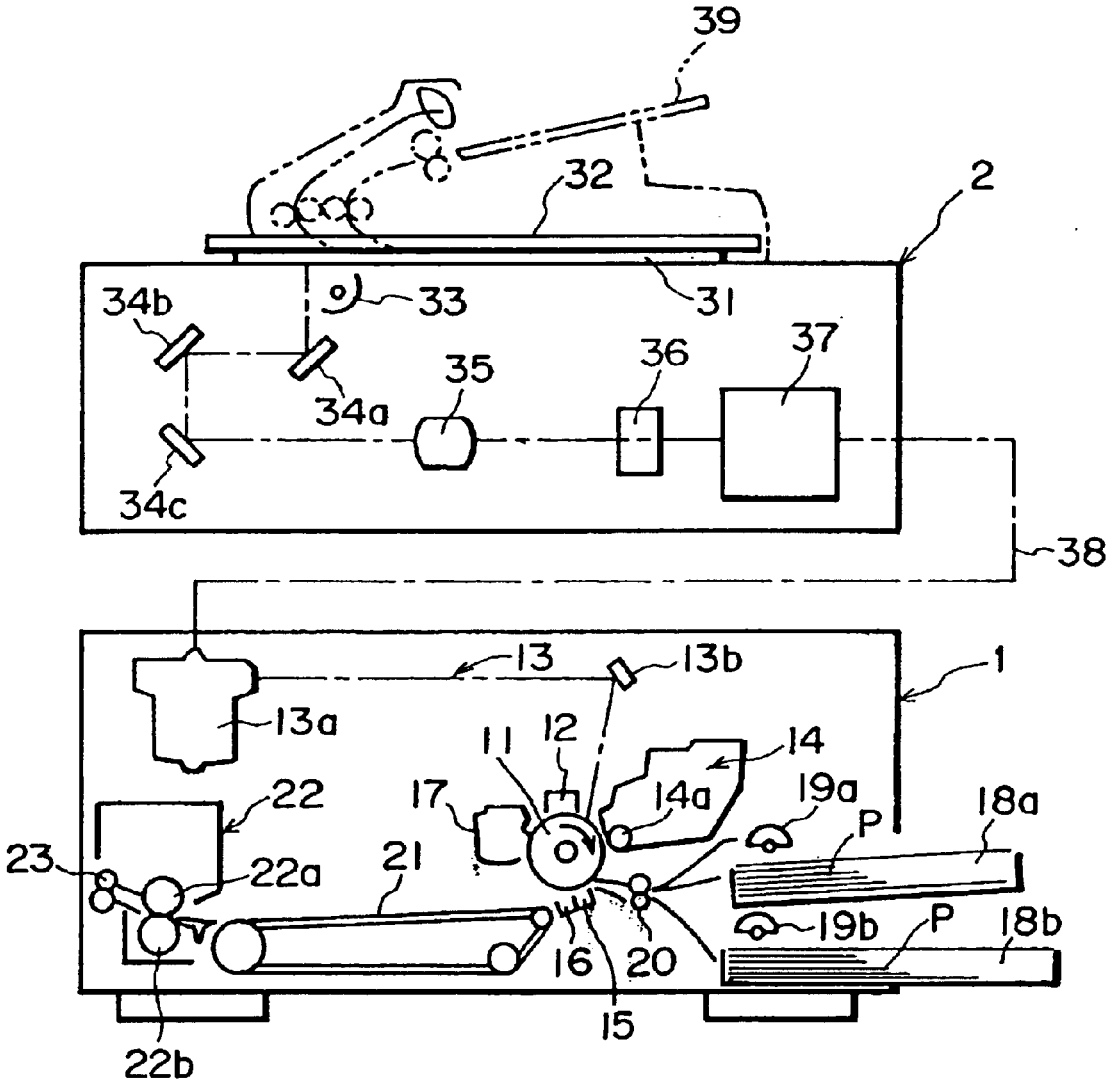
FIG. 1 is a schematic longitudinal sectional view of an image forming apparatus according to an embodiment of the present invention.

The preferred embodiments of the present invention will be described in conjunction with the accompanying drawings. In the accompanying drawings, the same reference numerals are assigned to the elements having the corresponding functions, and redundant detailed description is omitted for simplicity.

FIG. 1 shows an example of the image forming apparatus according to an embodiment of the present invention. The image forming apparatus is a laser beam printer, and FIG. 1 is a schematic longitudinal section thereof. In this example, the member to be cleaned by the cleaning device 17 according to this invention is a photosensitive drum 11.

The laser beam printer (image forming apparatus) shown in FIG. 1 comprises a printer station (image formation station) and a reader portion (image reading station).

The printer station 1 has an image bearing member in the form of an electrophotographic photosensitive member (photosensitive drum). Around the circumference of the photosensitive drum 11, there are provided a primary charger (primary charging means) 12, an exposure device (exposure means) 13, a developing device (developing means) 14, a transfer charger 15, a separation charger 16, and a cleaning device (cleaning means) 17 in the order named. There are sheet feeding cassettes 18*a*, 18*b*, sheet feeding rollers 19*a*, 19*b*, registration rollers 20, a conveyer belt 21, a fixing device (fixing means) 22 having a fixing roller 22*a* and a pressing roller 22*b*, discharging rollers 23 in the order named along the feeding direction of the recording material (paper for example) from the upstream side.

On the other hand, the reader portion 2 comprises a platen glass 31, an original pressing plate 32, a light source 33, reflection mirror 34*a*, 34*b*, 34*c*, a lens 35, a CCD (photoelectric conversion element) 36, an image processor 37 and so on.

In the print portion 1 of the image forming apparatus, the photosensitive drum 11 is located by a driving means (unshown) in the direction indicated by an arrow at predetermined process speed (peripheral speed), and during the rotation, the surface of the photosensitive drum 11 is uniformly charged to a predetermined potential of a predetermined polarity by the primary charger 12. On the other hand, in the reader portion 2, the original (unshown) pressed on the platen glass 31 by the original pressing plate 32 is eliminated at the bottom surface (image surface) by the light source 33. The light reflected by the original is reflected by the reflection mirrors 34*a*, 34*b*, 34*c* and is passed through the lens 35 and is incident on the CCD 36. The light incident on the CCD 36 is subjected to known image processing by the image processor 37, and is converted to an electric signal 38, and is supplied to the exposure device 13 of the printer station 1 as image information to be printed.

The laser scanner 13*a* of the exposure device 13 projects the light moderated in accordance with the image information onto the surface of the electrically charged photosensitive drum 11 by way of the reflection mirror 13*b*. By the exposure of the surface of photosensitive drum 11, an electrostatic latent image is formed on the surface thereof.

The electrostatic plated image is developed by the developing device 14. The developing device 14 contains a developer (toner), which is transferred onto the electrostatic latent image on the surface of the photosensitive drum 11 by applying a developing bias voltage to the developing sleeve 14*a*, by which the electrostatic latent image is visualized into a toner image.

The toner image formed on the photosensitive drum 11 in this manner is then transferred onto a recording material P. The recording material P is fed out of the sheet feeding cassette 18*a* or the sheet feeding cassette 18*b* by the sheet feeding roller 19*a* or the sheet feeding roller 19*b*, and is fed into the transfer portion formed between the photosensitive drum 11 and the transfer charger 15 with timed relation with the toner image on the photosensitive drum 11 by the registration rollers 20. The toner image on the photosensitive drum 11 is transferred onto the recording material P by application of a transfer bias to the transfer charger 15.

The recording material P, after the toner image transfer, is separated from the surface of the photosensitive drum 11 by the separation charger 16, is supplied into the fixing device 22 by the conveyer belt 21. In the fixing device 22, the recording material P is heated and pressed by the fixing roller 22*a* and the pressing roller 22*b*, by which the toner image is fixed on the surface of the recording material P. Then, the recording material P is discharged to an outside of the main assembly of the image forming apparatus by the discharging rollers 23.

On the other hand, the photosensitive drum 11, after the toner image transfer, the cleaning device 17 removes from the photosensitive drum 11 the residual toner (deposited matter) not having been transferred but remaining on the surface thereof, so that photosensitive drum 11 is prepared for the next image forming operation. The cleaning device 17 will be described in detail hereinafter.

In FIG. 1, an automatic original feeding device 39 is indicated by chain lines. The automatic original feeding device 39 is disposed above the original pressing plate 32 and functions to automatically supply the originals onto the platen glass 31 and of optically discharge the original from the platen glass 31.

Figure 2:
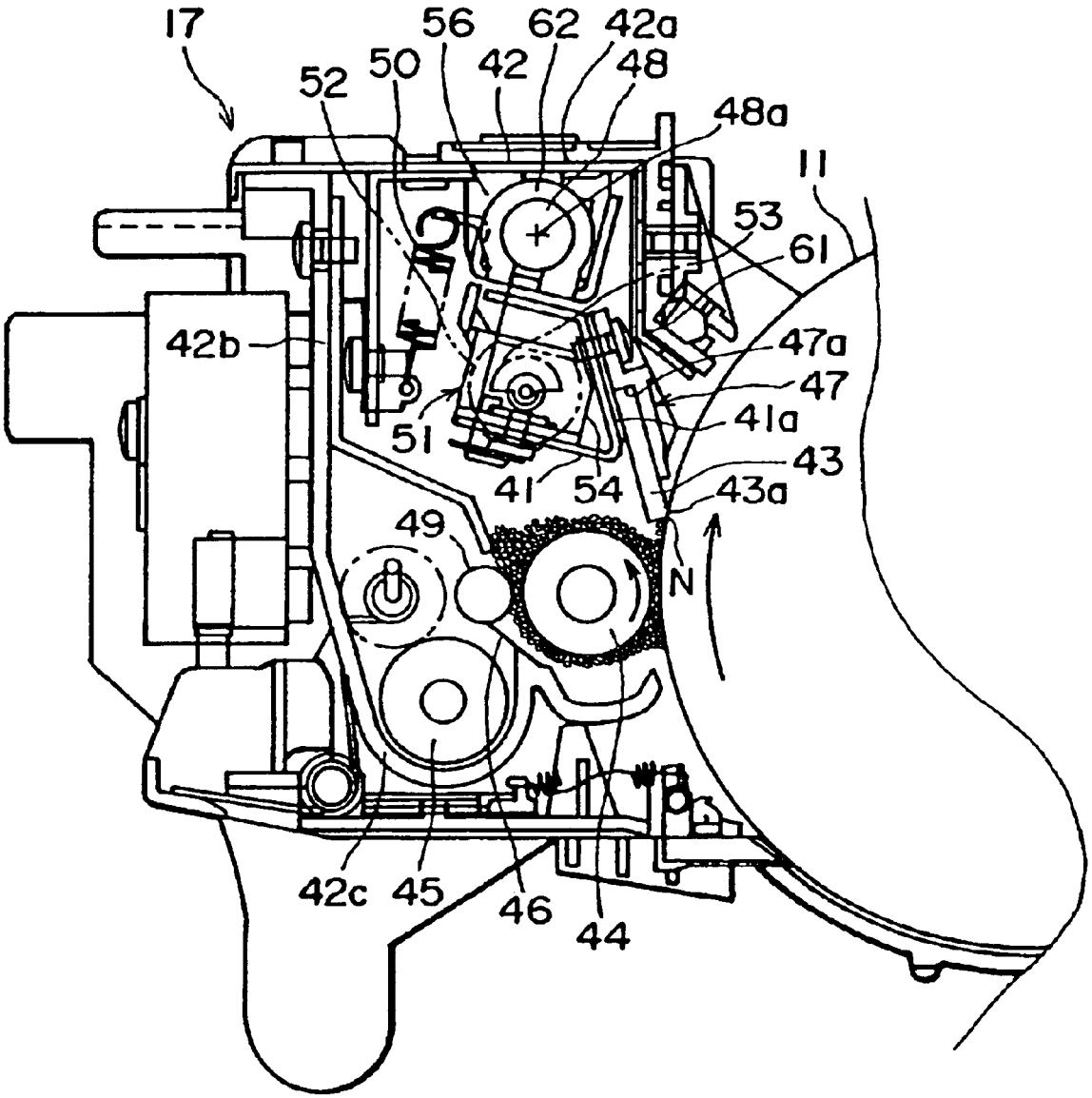
FIG. 2 is a schematic longitudinal sectional view of a cleaning device according to an embodiment of the present invention.

Referring to FIG. 2, the cleaning apparatus 17 in accordance with the present invention will be described in detail. FIG. 2 is a vertical sectional view of the cleaning apparatus 17, at a plane perpendicular to the lengthwise direction (axial direction) of the photoconductive drum 11.

The cleaning apparatus 17 comprises a frame 41 (first frame), a frame 42 (second frame), a cleaning blade 43 (cleaning member), a magnetic roller 44, a conveying screw 4*b*, a sheet 46, a holder 47, shafts 48 and 49, a tension spring 50 (pressure generating means), and a vibration generating means 51.

The cleaning blade 43 is formed of an elastic plate. It is held to the frame 41, being sandwiched between the frame 41, and the holder 47 attached to the frame 41 with the use of screws 61. One of the lengthwise edges of the cleaning blade 43 is placed in contact with the peripheral surface of the photoconductive drum 11, with the cleaning blade 43 tilted so that it counters the moving direction (indicated by an arrow mark) of the peripheral surface of the photoconductive drum 11. The portion 41*a* of the surface of the frame 41, with which the back side of the cleaning blade 43 is placed in contact, and the portion 47*a* of the surface of the holder 47, with which the end surface of the cleaning blade 43 is placed in contact, have been processed with high accuracy, and have been positioned also with high accuracy. In other words, the cleaning blade 43 is held to the frame 41, with a portion of the cleaning blade 43 being placed in contact with the portion 41*a* of the frame 41 and the portion 47*a* of the holder 47, so that the cleaning blade 43 is highly accurately positioned relative to the photoconductive drum 11. The frame 41, which holds the cleaning blade 43, also holds the vibrating means 50.

The frame 41 is pivotally attached to the frame 42, with the use of the shaft 48. One end of the tension spring 50 is connected to a part of the frame 42, and the other end of the tension spring 50 is connected to a part of the frame 41. Thus, the frame 41 is kept pressed by this tension spring 50 in the direction to pivot counterclockwise about the shaft 48 in the drawing. As a result, the edge 43*a* of the cleaning blade 43 is kept in contact with the peripheral surface of the photoconductive drum 11, generating a proper amount of contact pressure.

The frame 42 has a portion, which is vertical when the cleaning apparatus is in the image forming apparatus main assembly, and a portion, which extends toward the photoconductive drum 11 from the bottom end of the vertical portion. The aforementioned magnetic roller 44 and conveying screw 45 are rotationally supported by these two portions of the frame 42, and are rotationally driven by a driving means (unshown).

The magnetic roller 44 is disposed below the cleaning blade 43. Its peripheral surface is covered with a layer of residual toner which has been scraped down from the peripheral surface of the photoconductive drum 11 by the cleaning blade 43. The thickness of this residual toner layer is regulated by the sheet 46 and shaft 49. The magnetic roller 44 places its toner layer in contact with the peripheral surface of the photoconductive drum 11, across the area closest to the magnetic roller 44, from one lengthwise end of the photoconductive drum 11 to the other (direction parallel to the generatrix of the photoconductive drum 11), so that the peripheral surface of the photoconductive drum 11 is coated again with the residual toner. This is for the following reason. That is, if the peripheral surface of the photoconductive drum 11 is not re-coated with the residual toner after the residual toner is completely scraped down from the peripheral surface of the photoconductive drum 11 by the cleaning blade, the friction between the cleaning blade 43 and a portion of the peripheral surface of the photoconductive drum 11 with the residual toner, becomes different from the friction between the cleaning blade 43 and a portion of the peripheral surface of the photoconductive drum 11 with no residual toner, causing the cleaning blade 43 to micrometrically vibrate. Therefore, the peripheral surface of the photoconductive drum 11 is evenly coated with the removed residual toner to make uniform the friction between the cleaning blade 43 and photoconductive drum 11 in terms of the lengthwise direction of the photoconductive drum 11 in order to prevent the cleaning blade 43 from micrometrically vibrating. The "fresh" residual toner on the photoconductive drum 11 is scraped away, along with the "re-coated" residual toner, by the cleaning blade 43, and is recovered by the magnetic roller 44.

The sheet 46 is placed in contact with the shaft 49. It has the function of conveying to the conveying screw 45 the excessive amount of the residual toner on the peripheral surface of the magnetic roller 44. The conveying screw 5. conveys the residual toner to an unshown recovered residual toner container.

Figure 3:
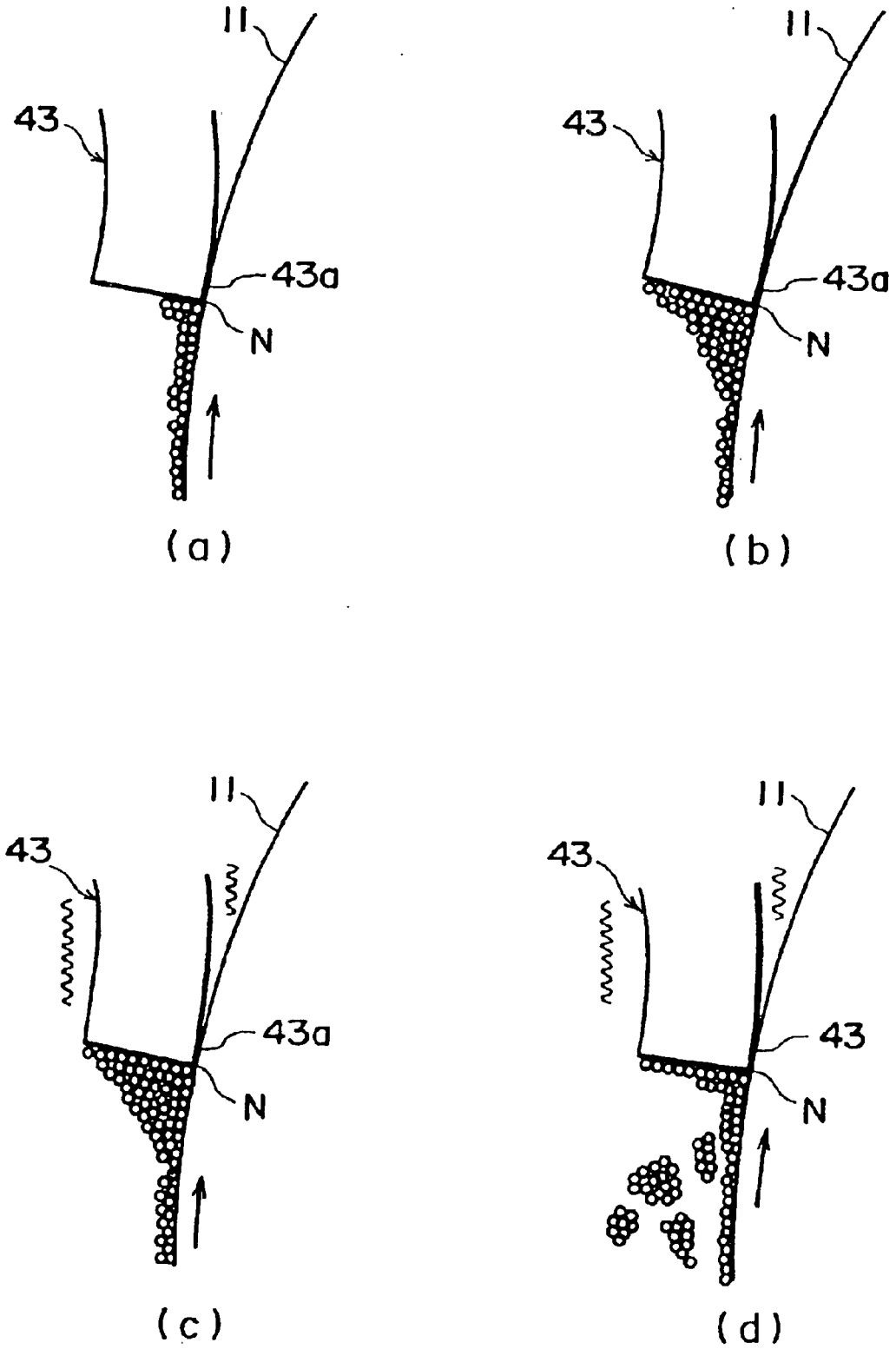
FIG. 3 ((*a*)–(*d*)) is enlarged views illustrating removal of the coagulated toner adjacent the edge of cleaning blade by vibration.

FIGS. 3(*a*), 3(*b*), 3(*c*), and 3(*d*) are enlarged views of the contact area between the peripheral surface of the photoconductive drum 11 and the edge 43*a* of the cleaning blade 43, and its adjacencies, in this embodiment of the present invention.

As the edge 43*a* of the cleaning blade 43 in contact with the photoconductive drum 11 scrapes the peripheral surface of the photoconductive drum 11, the residual toner particles agglomerate at the edge 43*a* as shown in FIG. 3(*a*). As the amount of the agglomerate residual toner particles at the edge 43*a* grows as shown in FIG. 3(*b*), there arises a possibility that a certain portion of the agglomerate residual particles will pass through the nip N between the edge 43*a*, and adheres to the recording medium P,. ruining the image thereon. Therefore, as the residual toner particles agglomerate at the edge 43*a*, they must be removed before the amount of the agglomerate residual toner at the edge 43 grows large enough for the residual particles to pass through the nip N.

Thus, in this embodiment, vibrations are transmitted (FIG. 3(*c*)) to the cleaning blade 43, through the frame 41, by activating the vibration generating means 51 (FIG. 1), so that the residual toner particles, which have agglomerated at the edge 43*a* of the cleaning blade 43, are removed from the edge 43*a* before formation of unsatisfactory images begins (FIG. 3(*d*)). However, as the vibration generating means 51 is activated, the vibrations therefrom propagate to the photoconductive drum 11 by way of the cleaning blade 43. Therefore, it is not desired for the vibration generating means 51 to be activated during image formation. Thus, it is not possible to frequently activate the vibration generating means 51. However, it was confirmed by experiments that stopping image formation for every 1,000th copy to operate the vibrating apparatus for approximately 0.5 second sufficed to remove the agglomerated residual toner particles. In other words, the effect of the operation of the vibrating means 5 for removing the agglomerated residual toner particles upon the ratio of the actual working time of the image forming apparatus is insignificant. Therefore, it is preferred that the image forming operation is temporarily stopped for every 1,000th copy, for example, to vibrate the cleaning blade 43 while image formation is not carried out.

Figure 4:
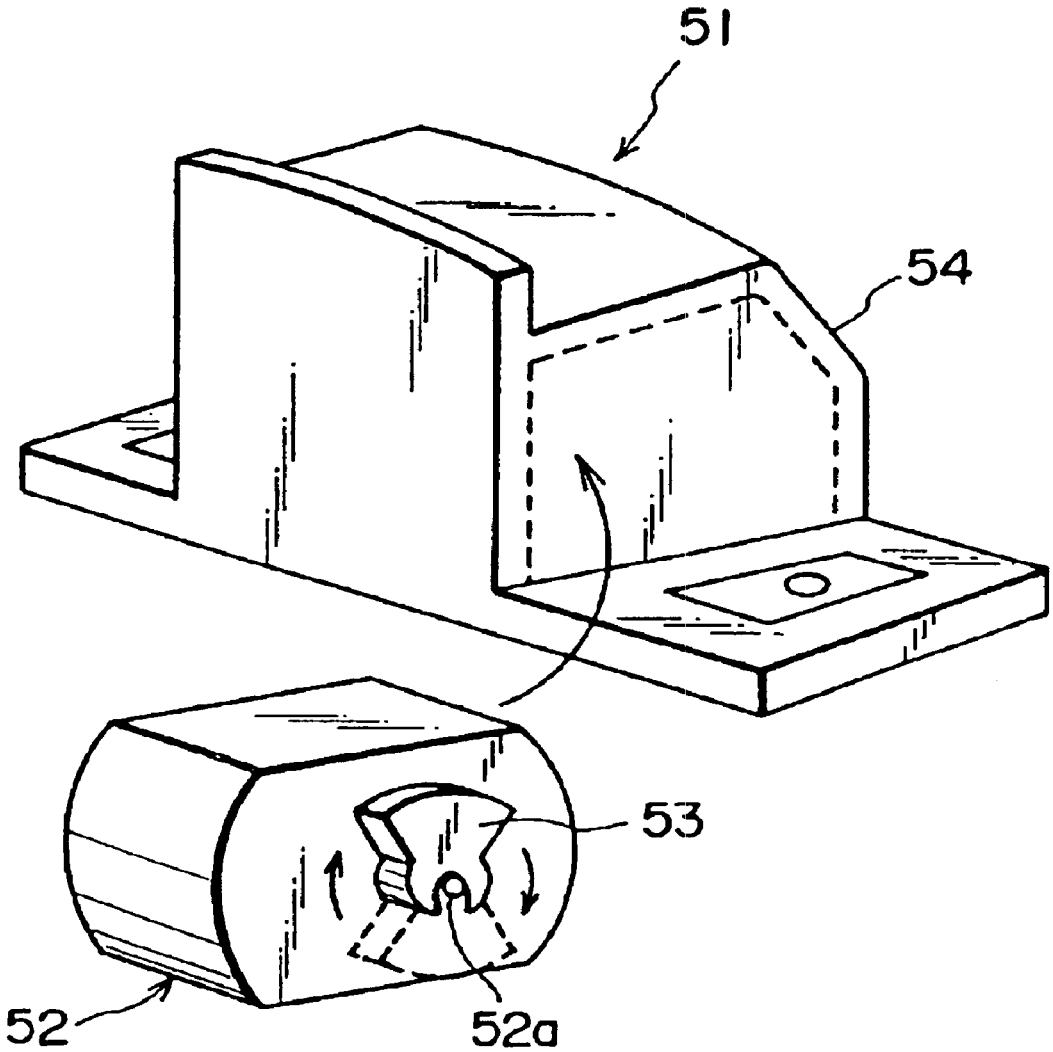
FIG. 4 is a perspective view of a motor and a case constituting the vibrating means.

FIG. 4 shows the structure of the vibration generating means 51 in this embodiment.

The vibration generating means 51 comprises a motor 52, a weight 53 attached to the output shaft 52*a* of the motor 52, and a case 54. The motor 52 is connected to a control circuit (unshown) and is stationarily disposed in the case 54. The case 54 containing the motor 52 is securely fixed to the frame 41 as shown in FIG. 1. The weight 53 is attached to the output shaft 52*a*, with its center of gravity offset from the output shaft 52*a*. Therefore, as the output shaft 52*a* of the motor 52 is rotationally driven by the control circuit, the motor 52 vibrates. These vibrations of the motor 52 propagate through the case 54 and frame 41, reaching the cleaning blade 43. The case 54 is given the function of preventing toner particles from entering the motor 52, and also, the function of efficiently propagating the vibrations of the motor 52 to the frame 41 by restraining the motor 52.

In the aforementioned experiments, the revolution of the motor 52 was set at 9,500 rpm. Incidentally, when the revolution of the motor 52 was kept within a range of 7,000 rpm–12,000 rpm, reasonably good results were obtained.

As long as vibrations effective to remove the agglomerated residual toner particles from the cleaning blade 43 can be given to the cleaning blade 43, the structure of the vibration generating means 51 does not need to be limited to the above described one.

Figure 5:
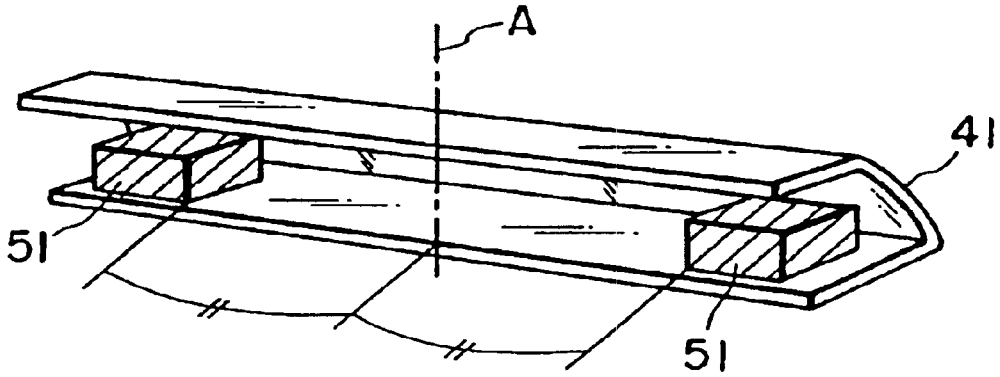
FIG. 5 is a perspective view of a frame provided with two vibrating means.
Figure 6:
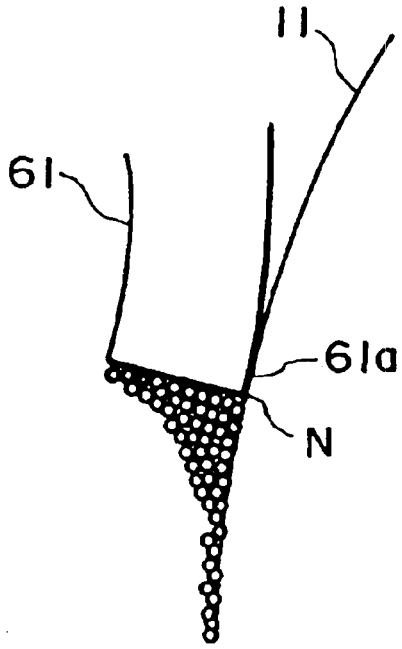
FIG. 6 is an enlarged view showing coagulation of the toner in the neighborhood of the edge of the cleaning blade.

The placement of a single vibration generating means 51 at the center of the frame 41 of the cleaning apparatus 17 in terms of the lengthwise direction of the frame 41 is sufficiently effective. In such a case, however, vibrations must be greater in amplitude in order for the vibrations to efficiently propagate to the lengthwise ends of the cleaning blade 43. Therefore, a plurality of the vibration generating means 51 may be attached to the frame 41 so that vibrations with a smaller amplitude can be uniformly propagated from one lengthwise end of the cleaning blade 43 to the other. For example, the vibration generating means 51 may be disposed at each lengthwise end of the frame 41, as shown in FIG. 5. In such a case, it is desired that the vibrating means 5 are symmetrically distributed with respect to the lengthwise center A of the frame.41 in order to minimize the unevenness in the contact pressure between the cleaning blade 43 and photoconductive drum 11, in terms of the lengthwise direction of the cleaning blade 43 (photoconductive drum 11).

The frame 42 (housing) is for recovering the residual toner after the residual toner is removed from the peripheral surface of the photoconductive drum 11 by the cleaning blade 43. The housing 43 comprises the top portion 42*a*, back portion 42*b*, and bottom portion 42*c*. It has an opening, which faces the peripheral surface of the photoconductive drum 11. The top portion 42*a* has a pair of supporting members 56 (only one is shown in the drawing), which are located at the lengthwise ends of the top portion 42*a*, one for one, and project downward, supporting the shaft 48, which is disposed so that its axial line 48*a* is virtually parallel with the generatrix of the photoconductive drum 11.

The top portion 42*a* has a pair of supporting members 56 (only one is shown in the drawing ), which are located at the lengthwise ends of the top portion 42*a*, one for one, and project downward, supporting the shaft 48, which is disposed so that its axial line 48*a* is virtually parallel to the generatrix of the photoconductive drum 11.

The entirety of the frame 41 is pivotally supported by the aforementioned shaft 48. Referring to FIG. 5, the frame 42 is structured so that the dimension of the frame 42 in the lengthwise direction of the cleaning apparatus is greater than the dimension of the frame 42 in the direction perpendicular to the lengthwise direction of the cleaning apparatus. It has the top and bottom portions, and the inclined portion which connects the top and bottom portions. It has an opening, which is on the back side. To the top surface of the bottom portion, the motors 51, or a vibrating means, are attached. To the front surface of the inclined portion, the holder 47 is secured with the use of the small screws 61, with a portion of the cleaning blade 43 being sandwiched between the holder 47 and the inclined portion of the frame 41. The top portion of the frame 41 is provided with a pair of bearing portions 62 (only one is shown in the drawing), which project from the lengthwise ends of the top portion, one for one, and through which the end portions of the aforementioned shaft 48 are inserted, one for one. In other words, the entirety of the frame 41 is pivotally supported by the shaft 48. The direction in which the frame 41 pivots is the virtually horizontal direction in the drawing, in other words, the direction in which the frame 41 approaches, or moves away from, the peripheral surface of the photoconductive drum 11. Further, the frame 41 is provided with a spring anchoring portion, which is located on the back side of the frame 41, and to which one end of the tension spring 50 is anchored.

The cleaning blade 43 is a member in the form of a piece of plate extending in the generatrix direction (lengthwise direction) of the photoconductive drum 11. It is formed of, for example, synthetic resin, and is flexible. It is secured to the frame 41, with its top side being sandwiched between the frame 41 and holder 47, so that its bottom side projects from the holder, with its edge 43*a* contacting the peripheral surface of the photoconductive drum 11.

Referring to FIG. 4, to the output shaft 52*a* of the motor 52, the weight 53 is attached in such a manner that its center of gravity is offset from the shaft 52*a*. The weight 53 in this embodiment is virtually fan-shaped. However, in principle, as long as the center of gravity of the weight 54 is offset from the output shaft 52*a*, the shape of the weight 53 does not need to be limited to the fan-shape. The motor 52 is disposed within the case 54. The motor 52 and case 54 together constitute a motor unit 51.

Figure 7:
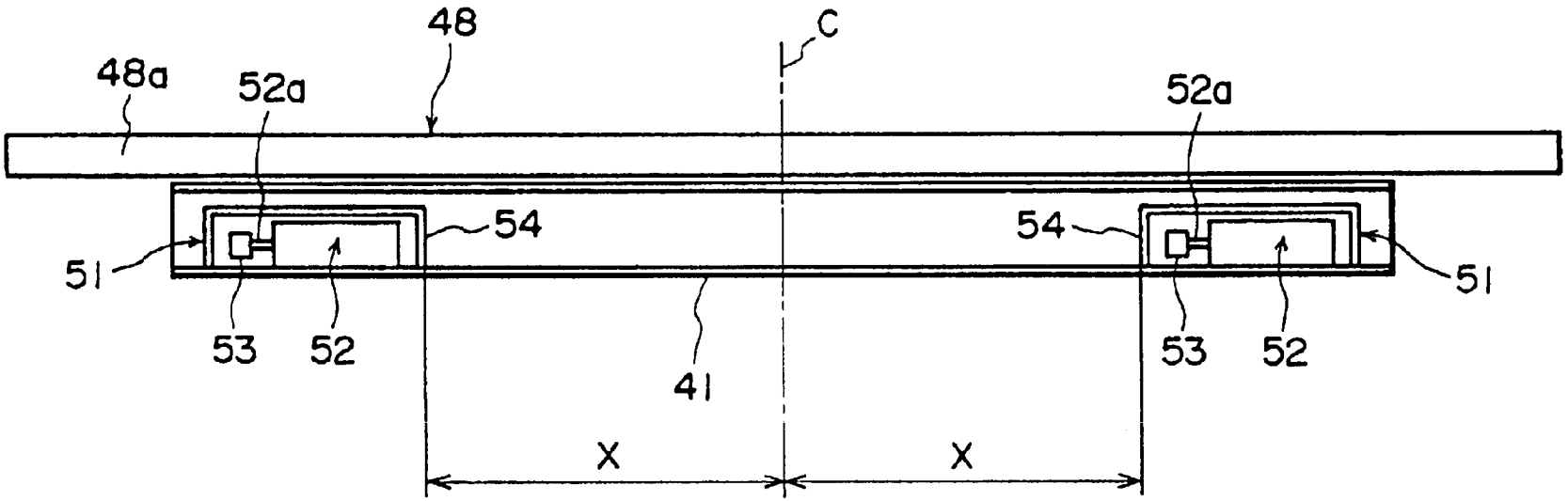
FIG. 7 is a longitudinal view of a frame provided with two vibrating means.

Referring to FIG. 7, the motor unit 51, which constitutes a vibration generating means, is attached to the top surface of each lengthwise end of the bottom portion of the frame 41. Incidentally, in FIG. 7, each lengthwise end portion of the case 51 is drawn with an imaginary window through which the motor 52 can be seen. The two motor units 51 are positioned so that the distance x from one motor unit 51 to the center C of the frame 41 in terms of the lengthwise direction of the frame 41 becomes the same as the distance x' from the other motor unit 51 to the center C, and also so that the output shaft 52*a* of each motor 52 becomes virtually parallel with the axial line 48*a* of the shaft 48. In the drawing, each weight 53 is positioned on the left side of the corresponding motor 51. However, the weights 53 may be positioned so that both are on the right side of the corresponding motors 51, or one is on the right side of the corresponding motor 51, whereas the other is on the left side of the corresponding motor 51. To both motors 51, the control circuit (unshown) is connected to control the motors 51 so that the two weights 53 are rotated in the same direction.

Incidentally, when the two motors 51 and the two weights 53 are positioned as shown in FIG. 7, it is preferable that the two motors 51 are controlled so that the rotational direction of one weight 53 becomes opposite to that of the other weight 53, because such an arrangement can intensify the vibrations of the frame 41.

The tension spring 50 as a pressure generating elastic member is positioned between a part of the housing 42 and the spring anchoring portion of the frame 41, keeping the entirety of the frame 41, which is pivotally supported by the shaft 48, pressured in the direction to rotate counterclockwise, in the drawing, about the shaft 48. As a result, the edge 43*a* of the cleaning blade 43 is kept in contact with the peripheral surface of the photoconductive drum 11, generating a predetermined amount of contact pressure. Since the shaft 48 is positioned virtually in parallel with the generatrix of the photoconductive drum 11, the contact between the peripheral surface of the photoconductive drum 11 and the edge 43*a* the cleaning blade 43 forms the nip N (FIG. 3) between the peripheral surface of the photoconductive drum 11 and the edge 43*a* which extends in the direction of the generatrix of the photoconductive drum 11.

As described above, in this embodiment, the frame 41 which is supporting the cleaning blade 43 is pivotally supported by the shaft 48 virtually in parallel with the generatrix of the photoconductive drum 11, and also, the output shaft 52*a* of the motor 52 is positioned virtually in parallel with the shaft 48. Therefore, the micro-vibrations generated by the combination of the motors 52 and weights 53 are efficiently transmitted to the edge 43*a* of the cleaning blade 43, micrometrically vibrating the edge 43*a* in the direction to cause the edge 43*a* to contact, or move away from, the peripheral surface of the photoconductive drum 11, in the contact nip N between the peripheral surface of the photoconductive drum 11 and the edge 43*a* of the cleaning blade 43. As a result, the residual toner particles are satisfactorily removed as they agglomerate at the edge 43*a*.

The above-described structure efficiently generates satisfactory vibrations for dislodging the agglomerate residual toner particles, making it possible to accomplish such objects as reducing the size of a vibration generation motor, reducing the power consumption, and the like.

As long as vibrations satisfactory for removing the agglomerate residual toner particles can be generated, the number and structure of the motor unit 51 does not need to be limited to those described above. For example, two motor units 51 may be disposed so that the distance from one motor unit 51 to the lengthwise center C of the frame 41 becomes different from the distance from the other motor unit 51 to the center C.

Embodiment 2

Figure 8:
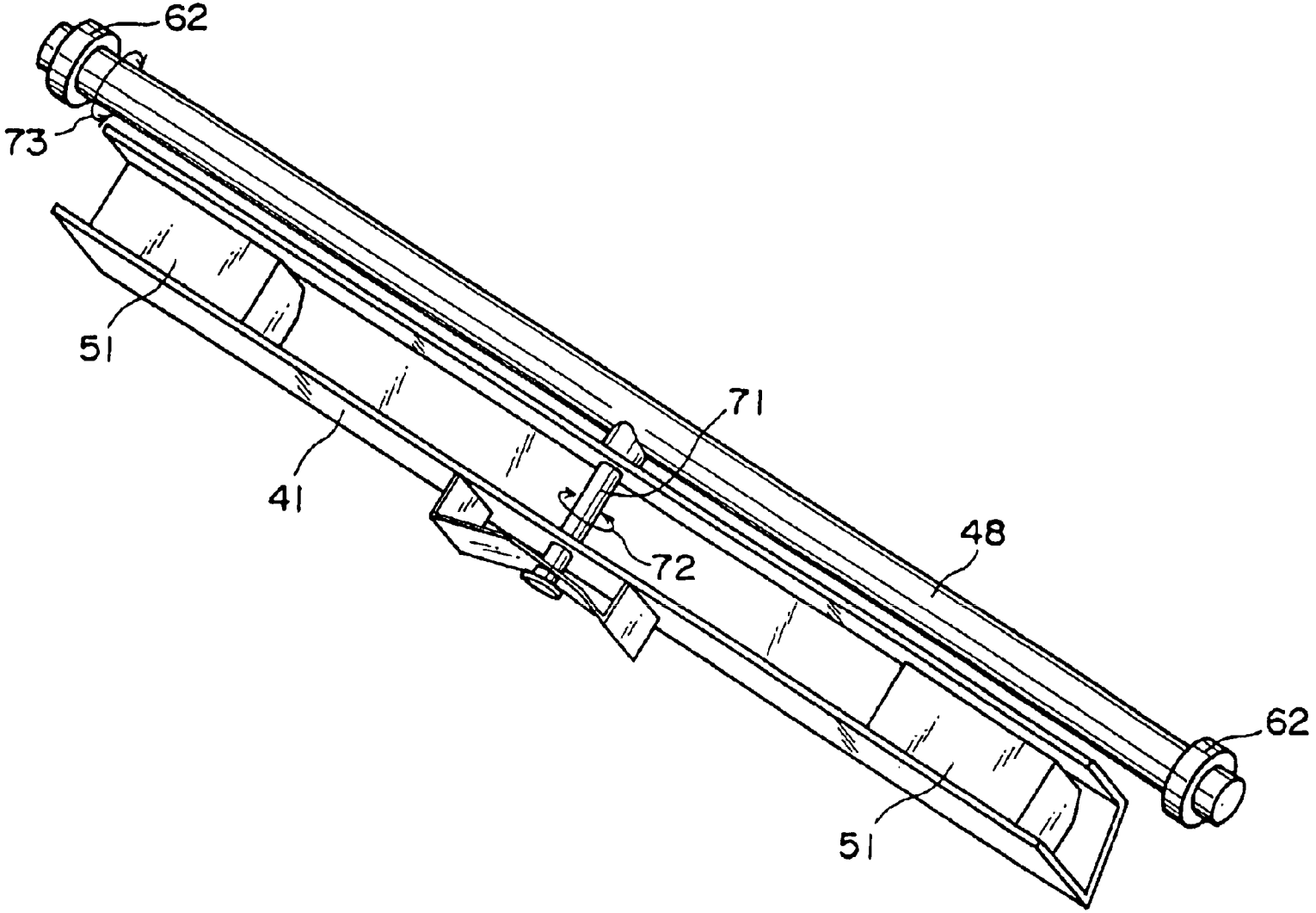
FIG. 8 shows another example of supporting the frame.

In the preceding embodiment, the top and bottom halves of the supporting member for supporting the cleaning blade were two integral parts of the supporting member. In this embodiment, however, they are made independent from each other. More specifically, the top half having the shaft 48, bearings 63, and pressure generating means anchoring portion is provided with a pin 71, which projects virtually straight downward, and to which the frame 41 is attached, as shown in FIG. 8. With the provision of this structural arrangement, not only is the frame 41 pivotable in the direction indicated by an arrow mark 73, but also in the direction indicated by an arrow mark 72. Otherwise, the vibrating apparatus structure in this embodiment is the same as that in the first embodiment.

This structural arrangement makes the contact pressure generated between the peripheral surface of the photoconductive drum 11 and the cleaning blade 43 as the cleaning blade 43 is placed in contact with the peripheral surface of the photoconductive drum 11 by the pressure applied to the cleaning blade 43 from the tension spring 50, by way of the frame 41, uniform across the contact nip N in terms of the lengthwise direction of the cleaning blade 43, stabilizing the cleaning apparatus in terms of cleaning performance.

In the preceding embodiments, two motors 51 were employed. However, three or more motors 51 may be employed. When the number of the motors 51 is even, they should be symmetrically positioned with respect to the lengthwise center C of the frame 41, whereas when the number of the motors 51 is odd, it is recommended that the central one is placed at the center C, and the rest are symmetrically positioned with respect to the center C.

<Structure of Cleaning Blade>

Next, the characteristics required of a cleaning blade in accordance with the present invention will be described.

As the vibration generating means 51 is activated, the vibrations from the vibration generating means 51 cause the cleaning blade 43 to bounce, in other words, to separate, from the peripheral surface of the photoconductive drum 11 several tens of micrometers to several hundreds of micrometers, at the same frequency as the vibrations generated by the vibration generating means 51, even while the photoconductive drum 11 is not rotated. As the cleaning blade 43 separates from the peripheral surface of the photoconductive drum 11, a portion of the agglomerate residual toner particles which had been dammed up by the contact nip N between the cleaning blade 43 and the photoconductive drum 11 is sometimes allowed to migrate onto the downstream side (back side) of the cleaning blade 43 in terms of the moving direction of the peripheral surface of the photoconductive drum 11. If the distance by which the cleaning blade 43 separates from the peripheral surface of the photoconductive drum 11 is large, a substantial amount of the residual toner particles migrates onto the back side of the cleaning blade 43, and adheres to the residual latent image remaining on the peripheral surface of the photoconductive drum 11 after image transfer, appearing across the portion of an image formed during the following rotational cycle of the photoconductive drum 11.

The inventors of the present invention repeatedly carried out the following studies, discovering that for the efficient removal of the agglomerate residual toner particles from the cleaning blade 43 while preventing the phenomenon that a part of the agglomerate residual toner particles migrates onto the back side of the cleaning blade and effects an unsatisfactory image, it is effective to reduce the coefficient of impact resilience, that is, one of the physical properties of the cleaning blade 43, to no more than 40%.

Table 1 shows the results of an experiment in which five groups of elastic cleaning blades 43, which were different in coefficient of impact resilience, but identical in shape and hardness, were compared in terms of the formation of unsatisfactory images, the imperfections of which were traceable to the aforementioned downstream migration of the agglomerate residual toner particles onto the back side of the cleaning blade.

TABLE 1

| Coefficient of impact resilience | 33 | 37 | 40 | 43 | 48 |
|---|---|---|---|---|---|
| Defects due to back side toner | G | G | G | N | N |

G: No defect
N: Defective

In the experiments, the vibration generating means 51 was activated for one second, with the photoconductive drum 11 kept stationary, and then, a normal image forming operation was carried out. The obtained images were evaluated mainly for soiling. When the amount of the residual toner particles which were allowed to migrate onto the back side of the cleaning blade 43 by the vibrations from the vibration generating means 51 was large, the migrated residual toner particles electrostatically adhered to the residual electrostatic latent image on the photoconductive drum 11, that is, the residual latent image which remained on the photoconductive drum 11 after toner image transfer, in particular, the distinctive line portions, or the like, of the residual latent image, which were stronger in electric field; in other words, images were soiled.

Prior to the experiment, it was confirmed that the five groups of cleaning blades different in coefficient of impact resilience were not different in the effectiveness in removing the agglomerate residual toner particles. Then, the images formed after the vibration generating means 51 was activated at the minimum strength for effectively removing the agglomerate residual toner particles, were evaluated for the image defects traceable to the aforementioned downstream migration of residual toner particle migration onto the back side of the cleaning blade.

Whether the vibration generating means 51 was effective for removing the agglomerate residual toner particles or not was judged using the following method. First, an ordinary image forming operation was carried out to produce 10,000 A4 size copies, using the test apparatuses, in an ambience in which the temperature was 23° C. and the relative humidity was low at 5%, that is, an ambience in which the residual toner particles easily agglomerated. Then, it was confirmed that the edge of the cleaning blades 43 collected an approximately 1.5 mm–1.8 mm thick layer of agglomerate residual toner particles across its entire lengthwise range. Next, the vibration generating means 51 was activated at a predetermined strength for one second, with the photoconductive drum 11 kept stationary. Then, the cleaning blade 43 was gently separated from the photoconductive drum 11, and the thickness of the layer of the agglomerate residual toner particles remaining on the cleaning blade 43 was measured. When the thickness of this layer was no more than 0.3 mm, it was judged that the agglomerate residual toner particles had been effectively removed.

The method used to measure the coefficients of impact resilience of the cleaning blades in this embodiment is compliant to JISK6301. In this embodiment, the values of the coefficients of impact resilience of the cleaning blades were those measured at 40° C., unless specified.

The reason for measuring the coefficient of impact resilience at 40° C. is as follows. In the hollow of the photoconductive drum 11 in this embodiment, a drum heater (unshown) as a heating means was disposed to keep the temperature of the photoconductive drum 11 at approximately 40° C. (temperature control) in order to prevent the formation of an image with the appearance of flowing water. Thus, the cleaning blade 43 was always used at a temperature of approximately 40° C., or the image formation temperature.

In this embodiment, the temperature was kept at 40° C. However, as long as the temperature is within a range of 30° C.–49° C., the formation of images with the appearance of flowing water can be prevented. The application of the present invention is not limited to an image forming apparatus equipped with a temperature control mechanism for the photoconductive drum 11. Further, the value of the coefficient of impact resilience of the cleaning blade 43 has only to be within a range correspondent to the ordinary temperature range within which an image forming apparatus in accordance with the present invention is used.

As for the material for the cleaning blade 43, various conventional rubbers can be used. In particular, urethane rubber is preferable since it is superior in mechanical strength such as wear resistance. For example, polyurethane elastomer manufactured using the chemical reaction between commercially available polyol and polyisocyanate can be used with preferable results. As for the commercially available polyol, there are polyester polyol and polyether polyol. The examples of polyester polyol are polyethylene-adipate-ester polyol, polyethylene-butylene-adipate-ester polyol, or caprolactone-ester polyol, and the like, and the examples of polyether polyol are polyoxy-propylene glycol, and the like.

It became evident from the results the experiment shown in Table 1 that as long as the cleaning blade 43 was no more than 40% in coefficient of impact resilience, it was possible to prevent the phenomenon that images were soiled by the downstream migration of the residual toner particles onto the back side of the cleaning blade 43.

The following theory is not intended to limit the scope of the present invention. But, based on the studies of the above-described experiment, the inventors of the present invention theorized that the amount by which the agglomerate residual toner particles migrate downstream onto the back side of the cleaning blade 43, in other words, the amount of image soiling traceable to the downstream migration of the residual toner particles onto the back side of the cleaning blade 43, is dependent upon the coefficient of impact resilience of the cleaning blade 43, for the following reason. That is, the edge (free end) of a cleaning blade 43 higher in coefficient of impact resilience bounces higher from the peripheral surface of the photoconductive drum 11 than the edge of a cleaning blade 43 lower in coefficient of impact resilience. Thus, the amount by which the agglomerate residual toner particles migrate downstream onto the back side of a cleaning blade is smaller when the cleaning blade is lower in coefficient of impact resilience.

Next, the relationship between the coefficient of impact resilience of the cleaning blade 43 and the cleaning performance of the cleaning apparatus 17 will be described. Table 2 shows the results of the following experiment. That is, 10,000 A4 size copies were made, using the test apparatuses, the cleaning apparatuses of which were different in coefficient of impact resilience within a range of 5% –25% (identical in shape and hardness), in an ambience in which the temperature was 23° C. and the relative humidity was low at 50%. Then, the obtained copies were subjectively evaluated regarding the presence or absence of the image defect traceable to the cleaning failure.

TABLE 2

| Coefficient of impact resilience | 5 | 7 | 10 | 14 | 19 | 25 |
|---|---|---|---|---|---|---|
| Insufficient cleaning | N | N | G | G | G | G |

G: No defective cleaning
N: Defective cleaning

It had been confirmed in advance that under the above-described condition, the residual toner particles did not agglomerate. Thus, the cleaning failure indicated in Table 2 means such a cleaning failure that occurs regardless of the agglomeration of the residual toner particles.

The following theory is not intended to limit the scope of the present invention. But, based on the studies of the above-described experiment, the inventors of the present invention theorized that the cleaning performance of a cleaning apparatus is dependent upon the coefficient of impact resilience of the cleaning blade 43, for the following reason. That is, the higher the cleaning blade 43 in coefficient of impact resilience, the superior the cleaning blade 43 in conformity to the peripheral surface of the photoconductive drum 11, and responsiveness to the micro-vibrations, in the nip N, during the rotation of the photoconductive drum 11.

Based on the summarization of the results of the experiments given in Tables 1 and 2, it was evident that the employment of a cleaning blade 43, the coefficient of impact resilience of which is in a range of 10%–40%, made it possible to efficiently remove the agglomerate residual toner particles, with the use of the vibrations generated by the vibration generating means 51, while maintaining the cleaning performance of the cleaning apparatus at a preferable level, and also that it reduced the distance a cleaning blade 43 was bounced by the vibrations, preventing the agglomerate residual toner particles from migrate downstream onto the back side of the cleaning blade 43.

Thus, in this embodiment, a polyurethane elastomer cleaning blade 43, the coefficient of impact resilience of which was 30% at 40° C., and the hardness of which was 77 degrees in Hs, was employed.

Incidentally, the cleaning blade 43 in this embodiment was approximately rectangular in cross section. It was 30 mm in the dimension of its free (unattached) portion in terms of the direction perpendicular to the lengthwise direction of the photoconductive drum 11, 3 mm in thickness, and 350 mm in the dimension in terms of the direction parallel with the lengthwise direction (axial direction) of the photoconductive drum 11. Its free edge 43*a* was placed in contact with the peripheral surface of the photoconductive drum 11. The contact angle, or the angle of the edge 43*a* relative to the tangential line of the photoconductive drum 11 at the contact between the cleaning blade 43 and photoconductive drum 11, was 27 degrees, and the contact pressure as set to 13 gf/cm.

Mounting of the cleaning apparatus 17 equipped with the above-described cleaning blade 43 in an image forming apparatus in accordance with the present invention confirmed that the cleaning apparatus 17 in accordance with the present invention displayed stable cleaning performance, and that the image defects traceable to the downstream migration of the residual toner particles onto the back side of the cleaning blade 43, caused by the vibrations generated by the vibration generating means 51, did not occur.

As described above, according to this embodiment, in order to prevent the cleaning failure traceable to the phenomenon that the agglomerate residual toner particles migrate downstream onto the back side of the cleaning blade 43, the residual toner particles agglomerating in the adjacencies of the interface between the photoconductive drum 11 and cleaning blade 43 can be shaken down by vibrating the cleaning blade 43 with the use of the vibration generating means 51, making it possible to effectively prevent the occurrence of the image defects, or the soiling of the recording medium P, traceable to the cleaning failure.

Further, the agglomerate residual toner particles can be efficiently removed by the vibrations generated by the vibration generating means 51 while maintaining the cleaning performance at a preferable level. Moreover, the distance the cleaning blade 43 is bounded by the vibrations is smaller. Therefore, virtually no residual toner particle migrates downstream onto the back side of the cleaning blade 43, preventing the occurrence of the image defects traceable to the downstream migration of the residual toner particles.

To sum up, according this embodiment, the cleaning performance of the cleaning member can be kept stable at a preferable level by the vibrations generated and transmitted with the use of a simple structural arrangement, without incurring vibration related problems. Therefore, the residual toner particles on the photoconductive drum 11 can be satisfactorily removed without incurring a substantial cost increase.

As the cumulative length of the usage of the cleaning blade 43 increases, the cleaning blade 43 gradually wears due to friction, declining in cleaning performance. Thus, the cleaning blade 43 must be opportunely replaced. With the provision of the above described structural arrangement, the cleaning blade 43 itself can be simply replaced by removing only the holder 47, minimizing the cost of the components necessary for the replacement, and the number of steps necessary to be taken for the replacement. Further, the profile irregularity with which the cleaning blade 43 is attached is guaranteed by the profile irregularity of the cleaning blade anchoring surface 41*a* of the frame 41. Therefore, the replacement cleaning blade can be accurately attached to assure that the manner in which the replacement cleaning blade behaves as vibrations are transmitted thereto by the vibration generating means 51 becomes virtually identical to that of the replaced cleaning blade, which is very important.

In the preceding description of the embodiments of the present invention, the cleaning apparatus 17 was described as an apparatus for cleaning the peripheral surface of the photoconductive drum 11; in other words, the object to be cleaned was the peripheral surface of the photoconductive drum 11. The application of the present invention, however, is not limited to the above described cleaning apparatus; it is also applicable to a wide range of cleaning apparatuses which clean various objects other than the photoconductive drum 11. For example, it is applicable to a cleaning apparatus for removing the toner particles adhering to the surface of a photoconductive member in the form of a belt, an intermediary transfer drum, an intermediary transfer belt, or the like, with the results similar to those described above.

While the invention has been described with reference to the structures disclosed herein, it is not confined to the details set forth, and this application is intended to cover such modifications or changes as may come within the purposes of the improvements or the scope of the following Claims.

What is claimed is:

1. A cleaning device comprising:

a cleaning member for cleaning a surface of a moving image bearing member, while contacting the surface of the image bearing member;

supporting means for supporting said cleaning member;

vibrating means supported by said supporting means, wherein said vibrating means includes driving means for rotating a shaft of said vibrating means and a weight, which is mounted on said shaft such that a center of gravity of said weight is deviated from a rotational center of said shaft, wherein said cleaning member vibrates upon actuation of said driving means, and wherein said vibrating means is mounted such that a direction of vibration of said vibrating means includes a normal component relative to a tangent plane at a contact portion between the image bearing member and said cleaning member.

2. A cleaning device according to claim 1, wherein said cleaning member includes a cleaning blade, and wherein said shaft extends in parallel with a surface of said cleaning blade.

3. A cleaning device according to claim 1, wherein an axial direction of said shaft extends in parallel with the tangent plane member and perpendicular to a moving direction of the image bearing member.

4. A cleaning device according to claim 1, wherein said vibrating means includes a cover for covering said driving means and said weight.

5. A cleaning device according to claim 1, wherein said vibrating means is disposed along a line extending in parallel with the tangent contact plane and perpendicular to a moving direction of the image bearing member.

6. A cleaning device according to claim 4, wherein said vibrating means is disposed at a position, which is symmetrical with respect to a center of said supporting means, and along a line in a direction extending in parallel with the tangent contact plane and perpendicular to a moving direction of the image bearing member.

7. A cleaning device according to claim 2, wherein said vibrating means includes at least two vibrating devices each being disposed along a line extending in parallel with the tangent contact plane and perpendicular to a moving direction of the image bearing member, and wherein respective shafts of said at least two vibrating devices rotate in opposing directions.

8. A cleaning device according to claim 1, wherein said cleaning member has an impact resilience, which is not less than 10% and not more than 40%.

9. A cleaning device according to claim 8, wherein said cleaning member is made of urethane elastomer.

10. A cleaning device according to claim 8, wherein the impact resilience is measured substantially at a temperature of said cleaning member during operation of the cleaning device.

11. A cleaning device according to claim 1, wherein said supporting means detachably supports said cleaning member.

* * * * *